US010464203B1

(12) United States Patent
Osuna

(10) Patent No.: US 10,464,203 B1
(45) Date of Patent: Nov. 5, 2019

(54) TELESCOPIC EXTENSION FOR DRYWALL TOOLS

(71) Applicant: Cruz Osuna, Glendale, AZ (US)

(72) Inventor: Cruz Osuna, Glendale, AZ (US)

( * ) Notice: Subject to any disclaimer, the term of this patent is extended or adjusted under 35 U.S.C. 154(b) by 0 days.

(21) Appl. No.: 16/023,970

(22) Filed: Jun. 29, 2018

(51) Int. Cl.
*B25G 1/04* (2006.01)
*E04F 21/00* (2006.01)

(52) U.S. Cl.
CPC ..... *B25G 1/04* (2013.01); *E04F 21/00* (2013.01)

(58) Field of Classification Search
CPC .... A47L 9/32; B25G 1/04; B25G 3/12; B25G 3/18; B25G 3/04; B05C 17/0205; F16B 7/10; F16B 7/105; F16B 7/042; B21D 39/04; B21D 39/046; B21D 39/048; Y10T 16/473; Y10T 16/4719; Y10T 16/498; Y10T 16/4554; Y10T 403/32467; Y10T 403/598; Y10T 403/7079; Y10T 403/32475; Y10T 15/10; E04F 21/00
See application file for complete search history.

(56) References Cited

U.S. PATENT DOCUMENTS 4,662,771 A * 5/1987 Roe ..... B05C 17/0205 403/108
4,715,080 A * 12/1987 Rydzicki ..... B25G 3/12 15/146
5,220,707 A * 6/1993 Newman, Sr. ..... B05C 17/0205 15/144.4
5,515,574 A * 5/1996 Larson ..... B25G 1/04 15/144.4
5,579,557 A * 12/1996 Boden ..... B25G 1/04 15/144.4
5,593,196 A * 1/1997 Baum ..... B25J 1/04 294/174
5,682,641 A * 11/1997 Newman, Jr. ..... B05C 17/0205 15/144.4
5,725,865 A * 3/1998 Mane ..... A23G 3/36 424/400
5,926,961 A 7/1999 Uhl
6,199,245 B1 * 3/2001 Blessing ..... B25G 1/06 16/422
6,435,754 B1 * 8/2002 Canale ..... A47L 9/244 403/109.2
6,453,777 B1 * 9/2002 Newman ..... B25B 9/00 294/184
7,025,383 B2 * 4/2006 Canale ..... A47L 9/244 285/302

(Continued)

*Primary Examiner* — Chuck Y Mah
(74) *Attorney, Agent, or Firm* — Sanchelima & Associates, P.A.; Christian Sanchelima; Jesus Sanchelima

(57) ABSTRACT

The present invention is a telescopic extension which can be used to extend the reach of a tool and enables to use such a tool in elevated position. The telescopic extension includes a pole portion and a tool holding portion coupled to the pole portion. The pole portion includes an outer tube and an inner tube which can be reversibly locked together relative to each other to fix a variable length of the pole portion during use. The tool holding portion includes a cradle and a circular fitting pivotally connected with the cradle. The circular fitting is adapted to hold the tool in the telescopic extension, and further the pivot arrangement between the circular fitting and the cradle allows to rotate the tool to be set in a desired angle in the telescopic extension.

9 Claims, 2 Drawing Sheets

(56) References Cited

U.S. PATENT DOCUMENTS

| | | | | |
|---|---|---|---|---|
| 7,237,305 | B2 * | 7/2007 | Newman | B25B 13/48 15/144.4 |
| 7,984,811 | B2 * | 7/2011 | Gonzalez | E04H 4/1609 210/470 |
| 8,407,860 | B2 * | 4/2013 | Brennenstuhl | B25F 5/026 16/422 |
| 8,448,300 | B2 * | 5/2013 | Imaschewski | B25F 5/026 16/426 |
| 8,566,999 | B1 * | 10/2013 | Casey | A46B 5/0083 15/146 |
| 2001/0024594 | A1 * | 9/2001 | Taylor | B25G 1/04 403/109.7 |
| 2002/0088091 | A1 * | 7/2002 | Grote | B05C 17/0205 16/429 |
| 2004/0104321 | A1 * | 6/2004 | Marsolais | A47L 9/244 285/302 |
| 2007/0003361 | A1 * | 1/2007 | Wang | F16B 7/105 403/109.3 |
| 2008/0313858 | A1 * | 12/2008 | Blom | B25G 1/04 16/427 |
| 2009/0094791 | A1 * | 4/2009 | Blom | B25G 1/04 16/427 |
| 2014/0215738 | A1 * | 8/2014 | Hagans | B25G 1/06 15/144.2 |
| 2015/0020331 | A1 * | 1/2015 | Devir | A47L 13/10 15/144.2 |
| 2016/0023347 | A1 * | 1/2016 | Ho | B25G 1/04 16/429 |

* cited by examiner

TELESCOPIC EXTENSION FOR DRYWALL TOOLS

BACKGROUND OF THE INVENTION

1. Field of the Invention

The present disclosure generally relates to drywall preparation, and more particularly, relates to a telescopic extension with selectively adjustable length and for holding a tool that permit a user to comfortably reach areas of the drywall near high walls or ceiling.

2. Description of the Related Art

The use of gypsum wallboard or drywall has become the most common means of finishing the interior structure of most building structures. The installation and finishing of drywall boards or panels takes relatively little time for experienced workers, and provides a smooth surface for further finishing. However, operations, such as, cutting drywall panels to size remains one of the more labor intensive aspects of working with the material. The length of the cutting tool is often insufficient to reach all of the surfaces without the aid of a ladder or scaffolding, such as when cutting a higher wall or a ceiling in a room. Safety regulations have been introduced that prohibit the use of regular ladders or simple scaffolds in many circumstances, thus requiring more expensive and time consuming scaffold arrangements. Most often, the time required to install and remove such a scaffold is more than is required to complete the cutting operation.

Applicant believes that a related reference corresponds to U.S. Pat. No. 5,926,961 (referred to as '961 patent) which discloses a tree trimmer with telescopic rod. The disclosed hand-guided working tool has the telescopic rod with a first and a second end. A drive motor is connected to the first end of the telescopic rod. A working tool, connected to the second end of the telescopic rod, is driven by the drive motor. The telescopic rod includes an outer tube and an inner tube inserted with an inner end into the outer tube and displacable in the longitudinal direction of the telescopic rod. A first clamping member is connected to the first end of the outer tube for fixing the axial position of the inner tube. The inner tube has an outer mantle surface and the outer tube has an inner circumferential surface. The outer mantle surface is spaced at a radial distance from the inner circumferential surface. A first cylindrical bearing body is supported on the inner end of the inner tube. The first bearing body is displacably supported in the outer tube. The first clamping member has an inner circumferential guide surface matching the outer mantle surface of the inner tube such that the inner tube is secured coaxially relative to the outer tube by the first clamping member and the first bearing body.

The hand-guided working tool of the '961 patent provides a device for cutting with means for extending the length of the tool as desired. However, the reference does not provide any suitable means for attaching a standalone tool or changing orientation of the attached tool. Therefore, there is a need in the art to provide some extension means which can accommodate a user's desired tool and also allows to change its angular orientation for drywall preparation purposes. Documents describing the closest subject matter provide for a number of more or less complicated features that fail to solve the problems described above in an efficient and economical way. None of the documents suggest the novel features of the present invention.

SUMMARY OF THE INVENTION

It is one of the main objectives of the present invention to provide a telescopic extension which can be used to mount a suitable tool for reaching higher walls or ceilings for cutting thereof.

It is another objective of the present invention to provide a telescopic extension which allows for setting an angle of a tool attached thereto.

It is yet another objective of the present invention to provide a telescopic extension which is inexpensive, durable, easy to handle and further easy to manufacture.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Illustrative embodiments of the present invention are described below. The following explanation provides specific details for a thorough understanding of and enabling description for these embodiments. One skilled in the art will understand that the invention may be practiced without such details. In some instances, well-known structures, processes and functions have not been shown or described in detail to avoid unnecessarily obscuring the description of the embodiments.

It shall be noted that unless the context clearly requires otherwise, throughout the description, the words "comprise," "comprising," "include," "including," and the like are to be construed in an inclusive sense as opposed to an exclusive or exhaustive sense; that is to say, in the sense of "including, but not limited to." Words using the singular or plural number also include the plural or singular number, respectively while adhering to the concepts of the present invention. Furthermore, references to "one embodiment" and "an embodiment" are not intended to be interpreted as excluding the existence of additional embodiments that also incorporate the recited features.

Figure 1:
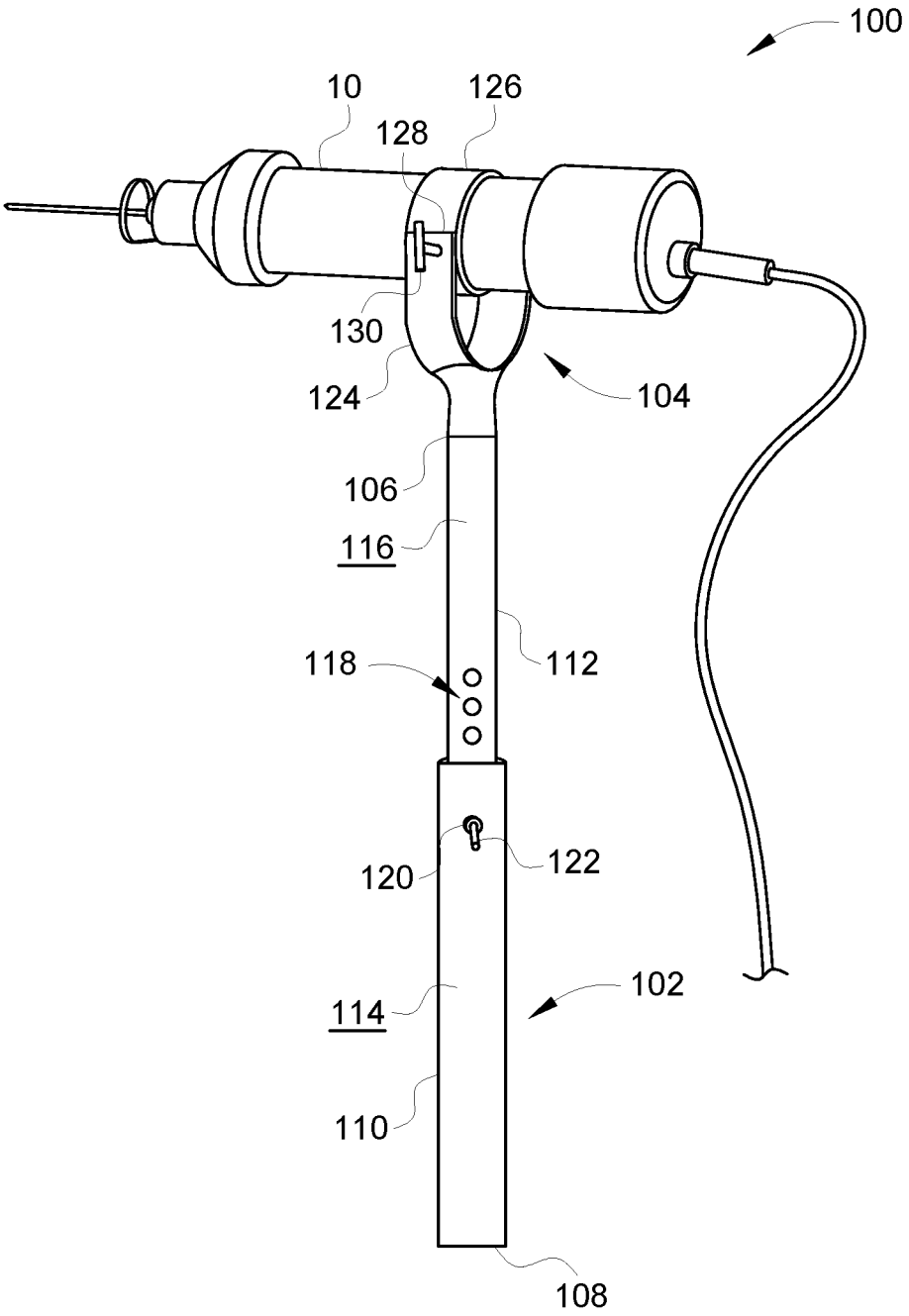
FIG. 1 illustrates a diagrammatic perspective view of a telescopic extension 100 holding a tool 10, in accordance with one or more embodiments of the present invention.

Referring to the drawings, FIG. 1 illustrate a diagrammatic view of a telescopic extension (referred by the numeral 100) to which a drywall tool 10 is mounted, in accordance with one or more embodiments of the present invention. The drywall tool 10 as referred herein may be any tool which may be utilized for working on installing or removing of the drywalls in home or commercial locations.

For example, the drywall tool 10 may be a cutting tool which may be utilized for removal of drywall for renovation and similar purposes. In other examples, the drywall tool may be a flat finishing tool which is often utilized for applying mastic to drywall joints during preparation of drywalls.

As illustrated in FIG. 1, the telescopic extension 100 includes a pole portion 102, and a tool holding portion 104 coupled to the pole portion 102. As shown, the tool holding portion 104 is coupled to the pole portion 102 at its distal end 106, away from its handling end 108. The pole portion 102 includes an outer tube 110 and an inner tube 112. The inner tube 112 is slidably coupled to the outer tube 110, such that the inner tube 112 telescopes within the outer tube 110 to change the length of the pole portion 102 in the telescopic extension 100. In one example, the outer tube 110 and the inner tube 112 have D-shaped cross-sections with flat faces 114 and 116, respectively. A series of holes 118 are formed in the flat face 116 of the inner tube 112. The series of holes 118 are disposed along a portion of the length of the inner tube 112. Further, a slot 120 may be formed in the flat face 114 of the outer tube 110 which corresponds to the portion of the length of the inner tube 112 with the series of holes 118, when the outer tube 110 and the inner tube 112 are slidably coupled with respect to each other.

In an embodiment, the outer tube 110 and the inner tube 112 may be reversibly locked together relative to each other to fix a variable length of the pole portion 102 during use. For example, the tubes 110 and 112 are locked together by a pin 122 arranged in the slot 120 on the outer tube 110, such that the pin 122 alternately engages one of a series of holes 118 along the length of the inner tube 112. In one example, the pin 122 is positioned in the slot 120 and may be spring-biased such that the pin 122 engages with one of the holes of the inner tube 112 and lock the inner tube 112 and the outer tube 110 together. In one or more examples, a maximum length of the pole portion 102, i.e. the combined length of the outer tube 110 and the inner tube 112 may be about 10 feet. Further, a maximum diameter of the pole portion 102 may be about 1-1.5 inches. However, it may be contemplated that the given dimensions are exemplary only and shall not be construed as limiting to the present invention in any manner.

In order to change the length of the pole portion 102, the user may pull out the pin 122 such that the pin 122 disengages from the hole 118, and allow the tubes 110 and 112 to telescope freely. Once the pole portion 102 has been extended or shortened to its desired length, the user applies pressure to the pin 122 to engage with the appropriate hole in the series of the holes 118 on the inner tube 112 to lock the outer tube 110 and the inner tube 112 together, and fix the length of the pole portion 102. This way the user can control the length of the telescopic extension 100 as desired within the limits of the combined length of the outer tube 110 and the inner tube 112. In alternate examples, the pole portion 102 may implement some other arrangement to increase or reduce its length and/or in the way the outer tube 110 and the inner tube 112 are locked/released at a desired length without any limitations.

Further, as illustrated in FIG. 1, the tool holding portion 104 includes a cradle 124 which is affixed to the distal end 106 of the pole portion 102. In the present examples, the cradle 124 is in the form of a semi-circular member. Also, the tool holding portion 104 includes a circular fitting 126 which is adapted to hold the tool 10. It may be understood that the circular fitting 126 may be dimensioned to have diameter for allowing proper mounting of the tool 10 inside thereof. In some examples, the circular fitting 126 may be in the form of a clamp which could be tightened against the tool 10 by using a screw or similar arrangements which are well known in the art. In the present embodiments, the circular fitting 126 is pivotally connected with the cradle 124. As illustrated, the circular fitting 126 may be connected to the cradle 124 at its ends 128 (only one may be seen in FIG. 1). The pivot arrangement between the circular fitting 126 and the cradle 124 allows to rotate the tool 10 to be set in a desired angle.

In an embodiment of the present invention, the circular fitting 126 may be connected to the cradle 124 by means of knurled handle 130 at the ends 128 providing the pivot connection. The knurled handle 130 may allow to tighten the cradle 124 against the circular fitting 126 by hand itself with the need of any particular tools. This tightening may prevent further pivot rotation of the circular fitting 126 and thereby allows to fix the angle of the tool 10 mounted in the circular fitting 126. For example, the knurled handle 130 may be rotated clockwise to prevent further rotation of the circular fitting 126 with respect to the cradle 124, and thereby the pole portion 102, thus fixing the angle of the tool 10 in the telescopic extension 100. Further, the knurled handle may be rotated in opposite counterclockwise direction to loosen the circular fitting 126 against the cradle 124, thus allowing rotation of the circular fitting 126 with respect to the cradle 124 and thereby allow for adjustment of the angle of the tool 10 with respect to the pole portion 102, in the telescopic extension 100.

Figure 2:
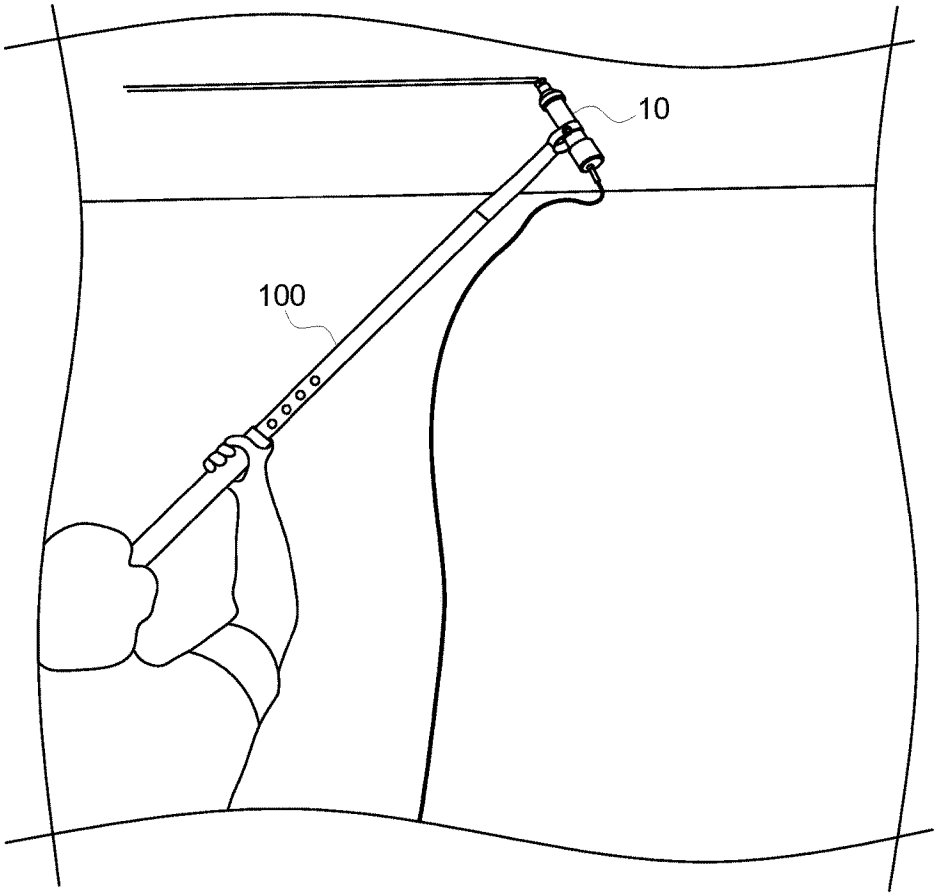
FIG. 2 illustrates a depiction of the telescopic extension 100 being implemented to extend reach of the tool 10 for working on a ceiling for drywall cutting purposes or the like, in accordance with one or more embodiments of the present invention.

FIG. 2 illustrates the telescopic extension 100 being implemented for allowing the tool 10 to reach a ceiling for drywall cutting purposes or the like. For this purpose, the user may first set the height of the pole portion 102 such that the tool 10 may reach the ceiling, and further set the angle of the tool 10 such that its cutting part may be facing and come in contact with the ceiling when the telescopic extension 100 is held in operation. As may be seen, the telescopic extension 100 is being held by the user at the handling end 108. Therefore, the telescopic extension 100 of the present invention can be used for handling a tool, such as the tool 10, at a desired height above the user. Although, the telescopic extension 100 has been described to be used with drywall cutting tools; in other example, the telescopic extension 100 may be used with other types of tools, such as tools for painting or brushing ceiling or side walls, for harvesting fruit from trees, for cutting tree branches, for collecting objects from high shelves or closets, or for hanging objects at a desired height, etc. As illustrated, the cord of the tool 10 may hang freely from the telescopic extension 100, which may be plugged into an outlet for supplying electric power for operation of the tool 10.

The telescopic extension 100 of the present invention extends the reach of the tool 10 and enables to use such a tool in elevated position. The telescopic extension 100 may eliminate the need of ladders, stilts or scaffolds, and further prevent possible injury due to falls from such raised platform. The telescopic extension 100 saves time and increases the efficiency on a jobsite. The telescopic extension 100 is easy to setup and use. The telescopic extension 100 may be made of materials to be very light to permit a user to hold the telescopic extension 100 along with the tool 10 easily and for a long working time, for example a whole day, and at the same time sufficiently stiff, to mount the tool 10 which may be a motorized tool. This may be particularly helpful for drywall preparation applications which may run for hours on a stretch.

The foregoing description conveys the best understanding of the objectives and advantages of the present invention.

Different embodiments may be made of the inventive concept of this invention. It is to be understood that all matter disclosed herein is to be interpreted merely as illustrative, and not in a limiting sense.

What is claimed is:

1. A telescopic extension for mounting a tool, the telescopic extension comprising:

a pole portion comprising:

an outer tube; and an inner tube slidably coupled to the outer tube, such that the inner tube telescopes within the outer tube to vary a length of the pole portion; and a tool holding portion coupled to the pole portion at distal end thereof, wherein the tool holding portion comprises a cradle which is affixed to the distal end of the pole portion, wherein the tool holding portion includes a circular fitting adapted to hold the tool, wherein the circular fitting is pivotally connected with the cradle to allow rotation of the tool to be set at a desired angle.

2. The telescopic extension of claim 1, wherein the outer tube and the inner tube have D-shaped cross-sections.

3. The telescopic extension of claim 2, wherein a series of holes are formed in a flat face of the inner tube.

4. The telescopic extension of claim 3, wherein the series of holes are disposed along a portion of the length of the inner tube.

5. The telescopic extension of claim 4, wherein a slot is formed in a flat face of the outer tube which corresponds to the portion of the length of the inner tube with the series of holes.

6. The telescopic extension of claim 5, wherein the outer tube and the inner tube are adapted to be reversibly locked together relative to each other to fix a variable length of the pole portion using a pin, wherein the pin is arranged in the slot on the outer tube such that the pin alternately engages one of the series of holes of the inner tube.

7. The telescopic extension of claim 6, wherein the pin is spring-biased to engage with one of the series of holes.

8. The telescopic extension of claim 1, wherein the cradle is in the form of a semi-circular member.

9. The telescopic extension of claim 1, wherein the circular fitting is connected to the cradle by a knurled handle configured to fix the angle of the tool mounted in the circular fitting.

* * * * *